US005092120A

United States Patent [19]

Pierino

[11] Patent Number: 5,092,120

[45] Date of Patent: Mar. 3, 1992

[54] METHOD AND MACHINE FOR THE FORMATION OF ORNAMENTAL CHAINS WITH CYLINDRICAL HELIX SHAPED LINKS

[76] Inventor: Maruffi Pierino, Via di S. Leo, 73, 52100 Arezzo, Italy

[21] Appl. No.: 468,620

[22] Filed: Jan. 23, 1990

[30] Foreign Application Priority Data

Jan. 24, 1989 [IT] Italy ..... 9321 A/89

[51] Int. Cl.[5] ..... B21L 7/00

[52] U.S. Cl. ..... 59/20; 59/16; 59/80; 59/83

[58] Field of Search ..... 59/16, 17, 20, 35.1, 59/83, 80

[56] References Cited

U.S. PATENT DOCUMENTS 2,617,250 11/1952 Kunzmann et al. ..... 59/17
4,903,475 2/1990 Bucefari et al. ..... 59/16

FOREIGN PATENT DOCUMENTS 329030 11/1918 Fed. Rep. of Germany ..... 59/20
280022 11/1930 Italy ..... 59/3

*Primary Examiner*—David Jones

*Attorney, Agent, or Firm*—McGlew & Tuttle

[57] ABSTRACT

A machine for the formation of ornamental chains with cylindrical helix-shaped links, comprising: a first section (A) for handling each loose link up to the connection thereof with the corresponding link, of the chain being in the process of formation, which has been last connected, with a handled vertical shaft (12) carrying a horizontal guide support (15) for a slide (16) of a collet-holder unit horizontally sliding between an inoperative retracted position and two advanced positions for seizing a loose link from a link-forming machine and for positioning the loose link in connection position, respectively; with a collet (35) for the hold of the loose link, which is subjected to a helicoidal feeding motion along its longitudinal axis to carry out the connection with the corresponding last link of the chain in the process of formation; a second section (B) for blocking the last link but one of the chain in the process of formation, with a hollow vertical motorized axially sliding shaft (42) carrying a horizontal guide (43) for a slide (44) equipped with two separate clamps (45, 46) and suitably movable for separately positioning the clamps (45, 46) at the blocking position for the blocking of a corresponding link of the chain in the process of formation.

11 Claims, 7 Drawing Sheets

Fig. 1
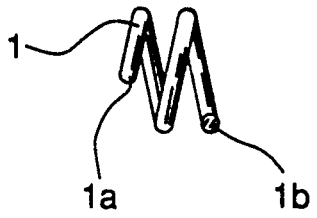
Fig. 2
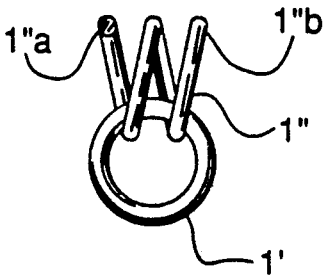
Fig. 3
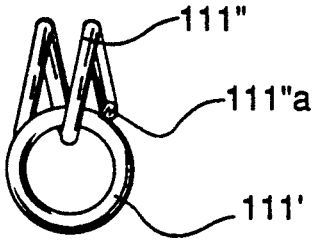
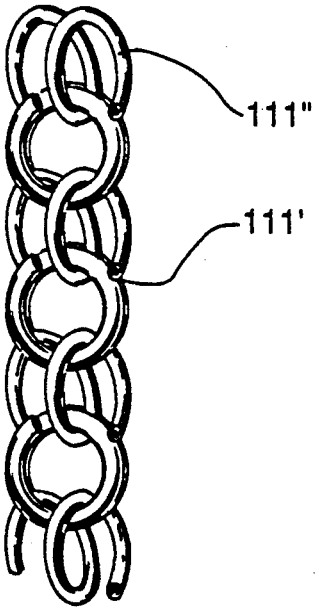
Fig. 4

Fig. 7
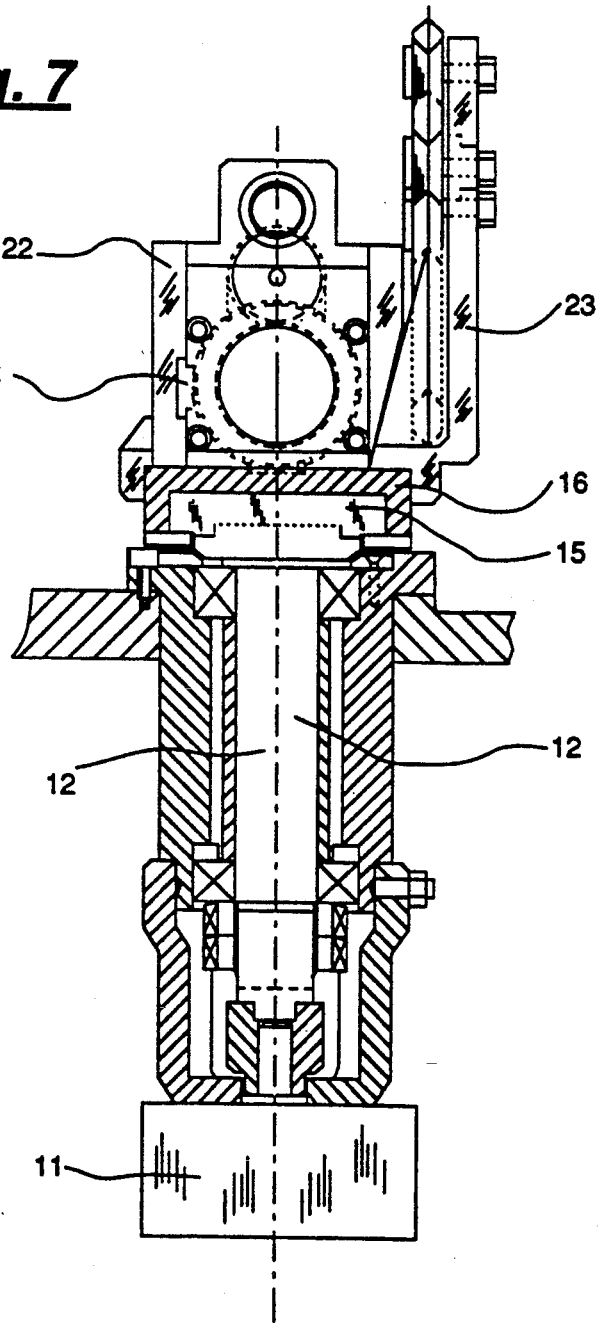
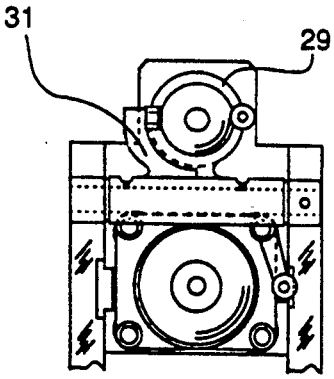
Fig. 8

METHOD AND MACHINE FOR THE FORMATION OF ORNAMENTAL CHAINS WITH CYLINDRICAL HELIX SHAPED LINKS

FIELD OF THE INVENTION

The present invention refers to a method for the formation of chains with cylindrical helix-shaped links for necklaces, bracelets, belts and the like, and to a machine for carrying out this method.

BACKGROUND OF THE INVENTION

It is known that chains of this type are made up of cylindrical helix-shaped links of a length slightly less than two loops and of a pitch approximately equal to a double thickness of the thread from which they are formed. At present, these chains are formed by manually linking, that is, connecting the links manually two-by-two through a spiral rotation of a link over a closed link already connected to the others. It is evident that the manual formation of these chains is time consuming and needs a great deal of attention and care by the operator. As above mentioned, these links are joined together by hand, that is, they are united between them two-by-two by a helicoidal rotation of a loose link with respect to an already closed link already linked to the others, thereby carrying out, alternatively, a free connection and a fixed connection, that is a so-called "Garibaldi module".

It is evident that the manual formation of such chains needs a lot of time as well as a great skill and care by the operator. As a consequence, the production of these chains is limited and their cost is so high that they are usually made only of precious metal such as gold and silver.

SUMMARY AND OBJECTS OF THE INVENTION

The present invention has the purpose of eliminating the above mentioned drawbacks by providing a method and a machine for the automatic formation of these chains with helical links. The present invention is able to improve the precision, rate and reliability of the production of the chains and thus drastically reducing the manufacturing costs.

This result has been achieved in accordance with the invention, by providing a method for making "Garibaldi modules" which comprises in sequence the following steps.

clamping a link of a "Garibaldi module" previously formed;

seizing a first link, previously loose, at the output end of a machine for the formation of cylindric helical links;

positioning the first link with its longitudinal axis substantially orthogonal to the link of the chain's "Garibaldi module" previously formed in order to allow its orientation and connection;

rotating the positioned first link about its own axis through approximately one and a half turns and simultaneously feeding it by approximately two pitches of the coil thereby obtaining a free and movable connection of the last link of the chain with the first link.

releasing the clamped link of the chain and clamping the overhanging link;

releasing the first link previously linked;

seizing a second link from the links feeding machine;

positioning the second link at a position where it is in a connectable relationship with the first link previously linked;

rotating the second link about its own axis and simultaneously moving it forward to obtain a fixed and immovable connection between the second and first links;

releasing the clamped link of the chain and clamping the overhanging link;

releasing the second link previously linked.

Thus the two immovably connected links make up a new "Garibaldi module" of the chain. According to a preferred embodiment, a machine for the automatic formation of chains with "Garibaldi modules" according to the method comprises:

a first section for handling the links up to the connection of the loose links, with a support rotating about a vertical axis, with a first collet for holding a loose link from a helical link-forming machine, this first collet is horizontally movable between an inoperative retracted position, an advanced hold position and a further advanced position for the positioning cf the loose link with respect to the chain's last connected link, and this first collet is also rotatable about its own longitudinal axis and slidable there along with a feed corresponding to the pitch of the link's helix to allow the connection of the held loose link to the last connected link;

a second section for clamping the next to the last connected chain link, with a support rotating about a vertical axis with two clamps slidingly mounted horizontally on the support. The two clamps are provided with grooved jaws corresponding to the spiral of a link, with the ends downward or upward directed, and driven to be positioned alternatively into the clamping position of the corresponding link of the chain being in the process of formation.

The advantages achieved from the present invention consist essentially in that it is possible to provide the automatic formation of chains with "Garibaldi modules"; to reduce drastically the production times and the relevant costs; and to improve the uniformity and reliability of the finished product, yet retaining a certain degree of versatility as far as the geometrical dimensions and the nature of the material of the links are concerned.

These and further advantages and characteristics of the invention will be more and better understood by any skilled in the art from a reading of the following description in conjunction with the attached drawings given only as a practical exemplification of the invention, but not to be considered in a limiting sense

BRIEF DESCRIPTION OF THE DRAWINGS

In the drawings:

FIG. 1 is an enlarged view of a helical link for an ornamental chain made up of "Garibaldi modules";

FIG. 2 is a view of a free connection with two links of FIG. 1;

FIG. 3 is a view of a fixed connection with two links of FIG. 1;

FIG. 4 is a view of a length of chain formed by "Garibaldi modules";

FIG. 7 is a sectional view on line C—C of FIG. 6;

FIG. 8 is a front view of a detail of the means for feeding the collet-holder shaft for the loose links;

DETAILED DESCRIPTION OF THE PREFERRED EMBODIMENT

Figure 5:
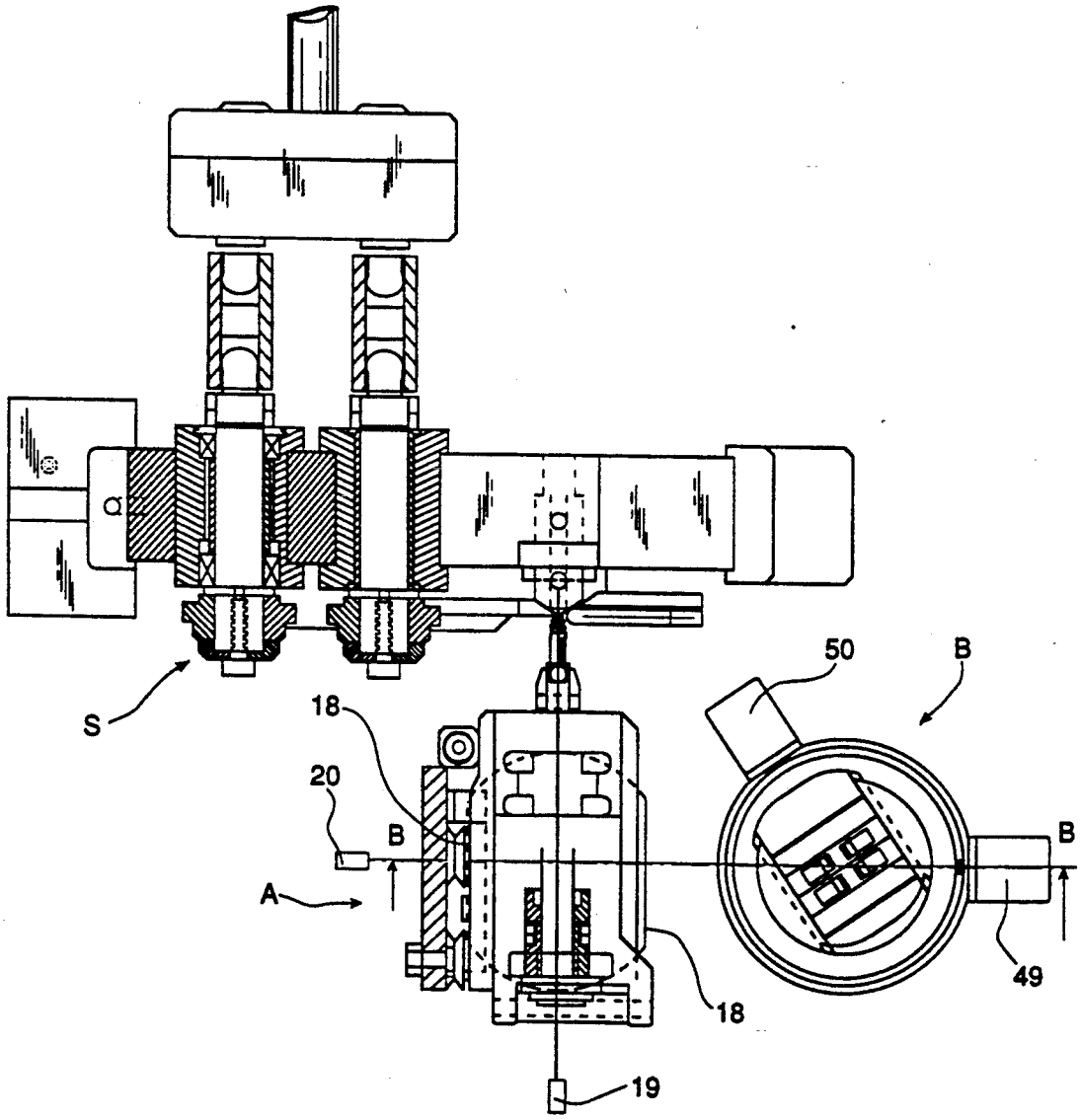
FIG. 5 is a plan view of a machine for the formation of chains according to the invention, associated with a machine for the formation of helical links.
Figure 6:
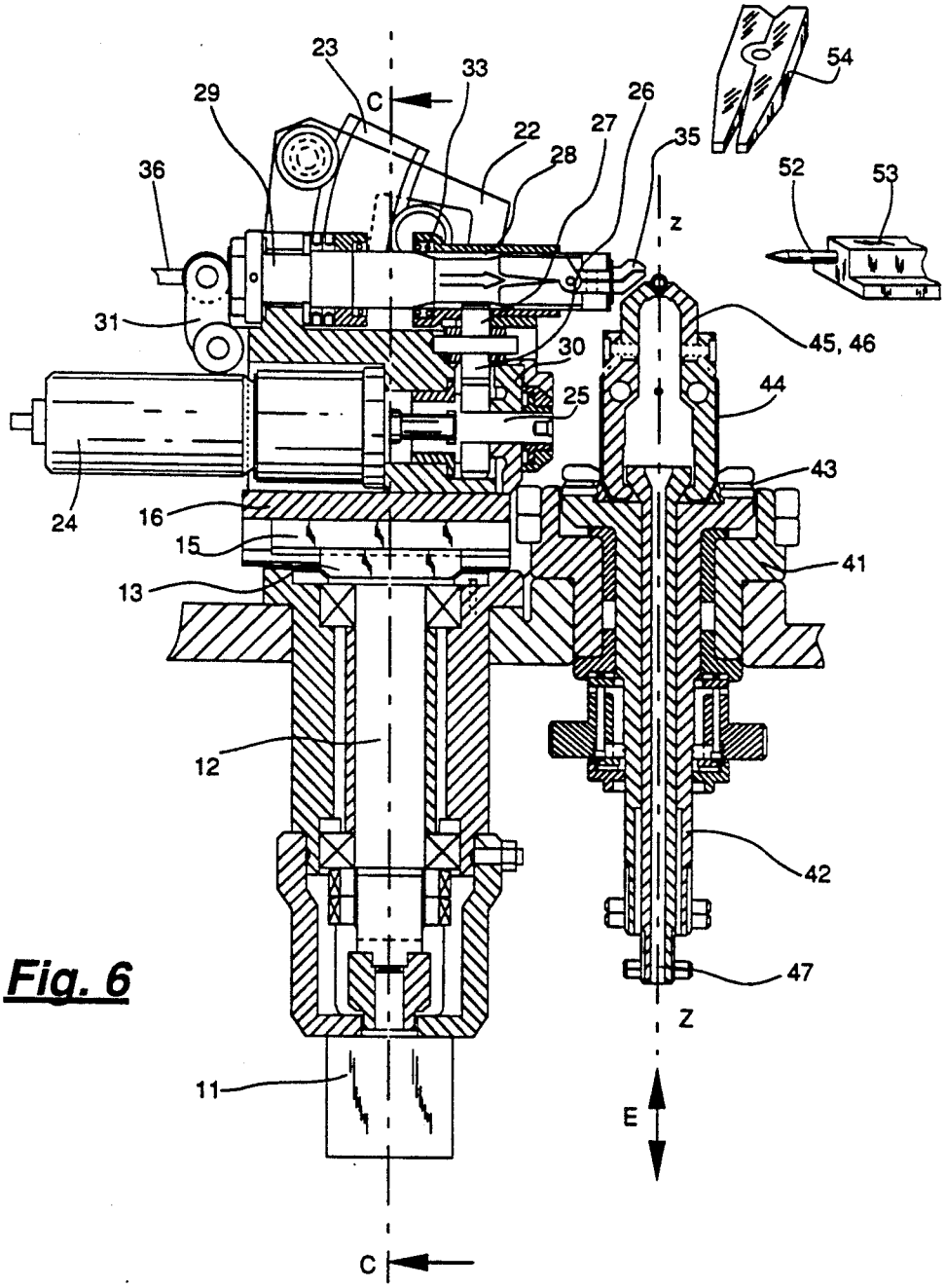
FIG. 6 is a sectional view on line B—B of FIG. 5.

As shown in FIG. 1, helical link 1 is the starting element for building a chain formed by "Garibaldi modules". The link is built, by known means, starting from a wire of predetermined nature and diameter, which is bent to achieve a helical shape, with a pitch slightly greater than two times the diameter of the wire, and so cut in such a way as to obtain links having a development slightly smaller than two loops, that is, of about 700° between the two ends 1*a*, 1*b* which result downwardly oriented.

FIG. 2 is a free and movable connection between helical links 1' and 1" with the ends (ends 1"*a*, 1'*a* and 1"*b* are visible in FIGS. 1 and 2) on the opposite side of the respective links from the actual contacts between the links.

FIG. 3 is a fixed and rigid connection between two links 111' and 111". The ends of the links (only 111*a* is visible in FIG. 3) are on the side of the links that are in contact with each other. The ends of each of the links interlock with the spirals of the other link to form a rigid connection and the "Garibaldi module".

Referring now to FIGS. 2 to 4 of the attached drawings, the method of formation of "Garibaldi modules" chains according to the invention comprises in sequence, the following steps:

clamping the lower link 111' of the last "Garibaldi module" previously formed, with the rigidly attached upper link having its axis horizontal and with its ends (111'*a* as shown) turned downwards; and separately:

seizing a first link, such as 1 previously loose, in the position where it comes out from helical link forming machine S, that is, with the link having its axis horizontal and the two ends 1*a*, 1*b* turned downwards;

positioning the first link 1 so that its axis is almost orthogonal to that of the last link such as 1' or 111' of the chain in the process of formation. The free end 1*b* in a connectable position to the link 1';

rotating the link 1 about its axis, in the direction of the helix, by almost a turn and a half, and simultaneously feeding it approximately a pitch and a half of the helix to achieve a free and movable connection with the link 1' as in FIG. 2; link 1 now appears as link 1";

unclamping the clamped link and clamping the overhanging chain link 1";

releasing the first link now appearing as 1" and presently clamped;

seizing a second link previously loose such as 1 from the link forming machine;

positioning the second link with its axis orthogonal to the above mentioned first link 1') or III' and with a free end such as 1*b* at a position for its connection with link 1" or 111';

rotating the second link in the helix direction and simultaneously feeding it by a helix pitch, so that the ends such as 1*b* will result downwardly oriented and interlocked with the spirals of the first link, represented by either 1" or 111', forming a fixed and rigid connection. The second link now appears as 111", and forms a "Garibaldi module" with line 111'. The process then repeats by forming another "Garibaldi module" on to the "Garibaldi module" just formed.

Advantageously, according to the invention, provision is made for ensuring a free connection of the first loose link 1' by operating on it two times, that is, with one round rotation of the link and one helix pitch feed thereof followed by the moving of the upper parts of the link loops close to one another and by the further link rotation by approximately half a round, and for ensuring the fixed connection of the second loose link " by operating the fastening of the first link 1' already connected. Moreover, in order to make the connection of links 1' and 1" easier, there is provided, according to the invention, that the link axis shall remain slightly outwardly inclined downwards.

According to a preferred embodiment of the invention, a machine for implementing the method according to the invention and with reference to FIGS. 5 to 8 of the attached drawings, is made up of:

A first section A for handling a loose link such as 1 from a link forming machine S to its connection with the last connected link of the chain clamped in a second section B which comprises:

a first shaft 12 preferably vertical engaged with an actuator 11, and provided on top with a horizontal support 13;

a horizontal guide 15 solid to the support 13, with a slide 16 for a collet-holder unit 17. The slide 16 has circular contour with two diametrically opposite flats 18 cooperating with two thrust actuators 19, 20 horizontally disposed between them to form 90° which cause advancement of the slide 16 together with the collet-holder. The return of slide 16 is achieved by means of a spring (not shown) inserted between the slide 16 and the guide 15;

a collet-holder unit with a support 22 sliding on a vertical circular sector 23 anchored on the slide 16 with a second shaft 29 preferably horizontal, whose free end carries a first collet 35 which is axially mounted for sliding on the support 22 and is driven into rotation by a driving shaft 25 through the gear train 26, 27, 28 yielding a drive ratio of 2:1; with a front cam 30, anchored to the end of driving shaft 25. The driving shaft drives the advancement of shaft 29 through a tappet 32 and a lever 31. The active profile development of cam 30 is of approximately 270° corresponding to a rotation of approximately 540° of the collet-holder shaft 29; the return of shaft 29 being achieved by means of a spring 33.

Advantageously the first collet 35 has jaws with a groove able to accommodate a helical link having shape and dimensions corresponding to those of link 1.

In addition, the axis of the jaws is parallel to that of shaft 29 and spaced therefrom of an extent equal to the radius of the link to allow helicoid motion during a connection. The automatic opening of the jaws of collet 35 is obtained by a spring at the moment a rod 36 having wedge-shaped head leaves the collet.

A second section B for clamping the next to the last connected link of the chain in the process of formation.

The second section having clamp portion means with a sleeve-like support 41 anchored to a base plate and wherein a vertical hollow motorized shaft 42 is fitted and whose upper end is so shaped as to provide a horizontal guide 43 for a clamp slide 44 supporting the two clamps 45, 46 articulated in juxtaposition in the sliding direction and able to be alternatively positioned in the clamping and releasing position with regard to the corresponding link on the vertical rotation axis 22 of slide 44 and of shaft 42. In a cavity of shaft 42 the chain in the process of formation is made to come down. A hollow rod 47, ducted on shaft 42, provided with a wedged head 48 to act upon the arm of clamps 45, 46 and vertically sliding, through the action of an actuator E, between an upper clamps-opening position and a lower clamps-closing position.

The jaws of the clamps 45, 46 are provided with grooves suitable for clamping a link 1 having its ends 1*a* and 1*b* oriented respectively downwards or upwards which are the positions provided for both types of connections. Two clamp actuators 49 and 50 are for displacing the support 44 and bringing into clamping position the clamp 45 or 46 respectively. A second collet 51 overhangs the clamps 45 and 46 and is able to slide vertically and moves the loops of the links that are being connected close to one another. A counteracting pin 52 horizontally sliding within a support 53 and penetrates between the end la and the central loop of a link such as 1″ which was previously connected, in order to make this link 1″ steady during the formation of the fixed and rigid connection with another link such as 1″ of the "Garibaldi module".

Figure 9:
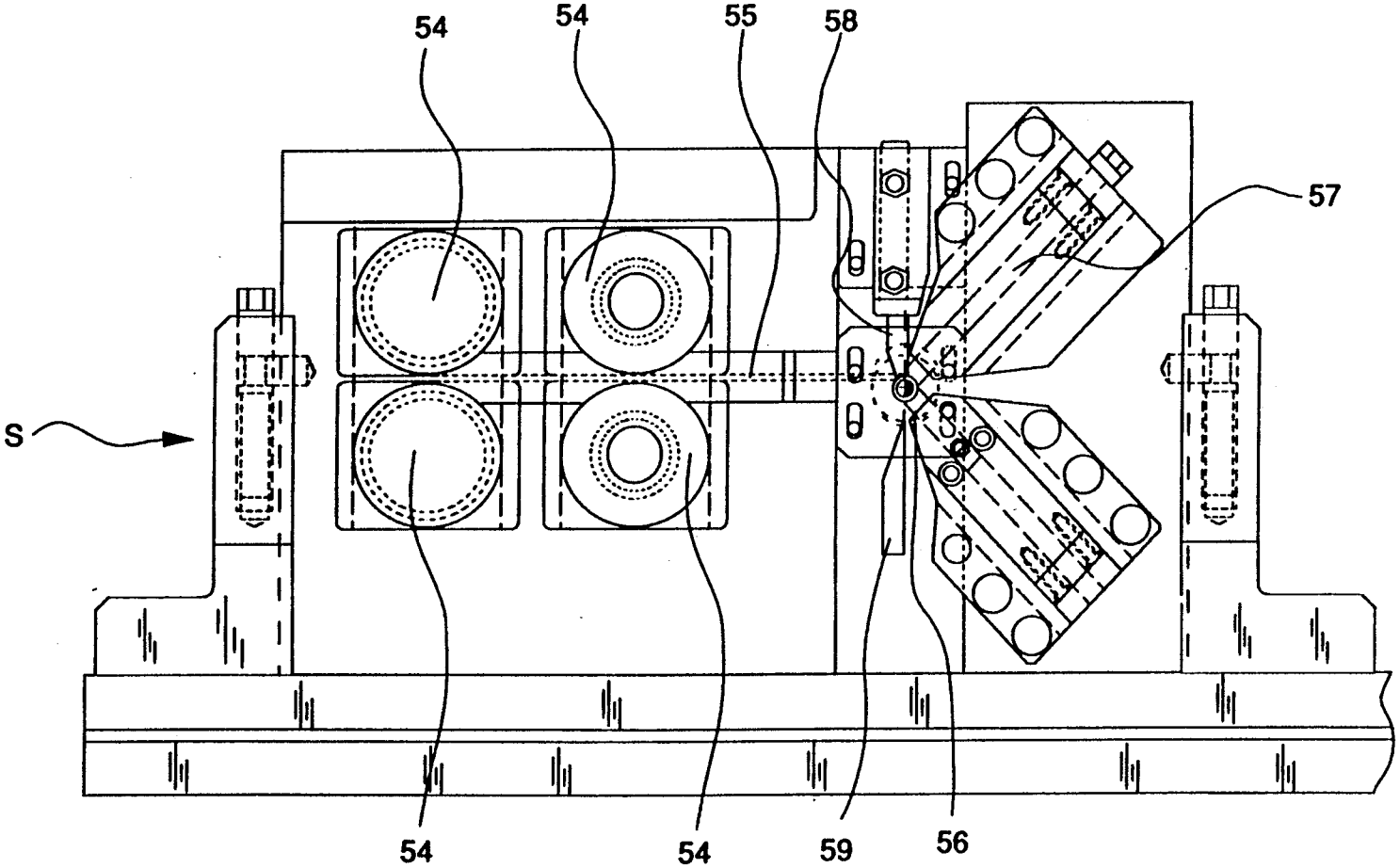
FIG. 9 is a front view of the link forming machine depicted in FIG. 5.
Figure 10:
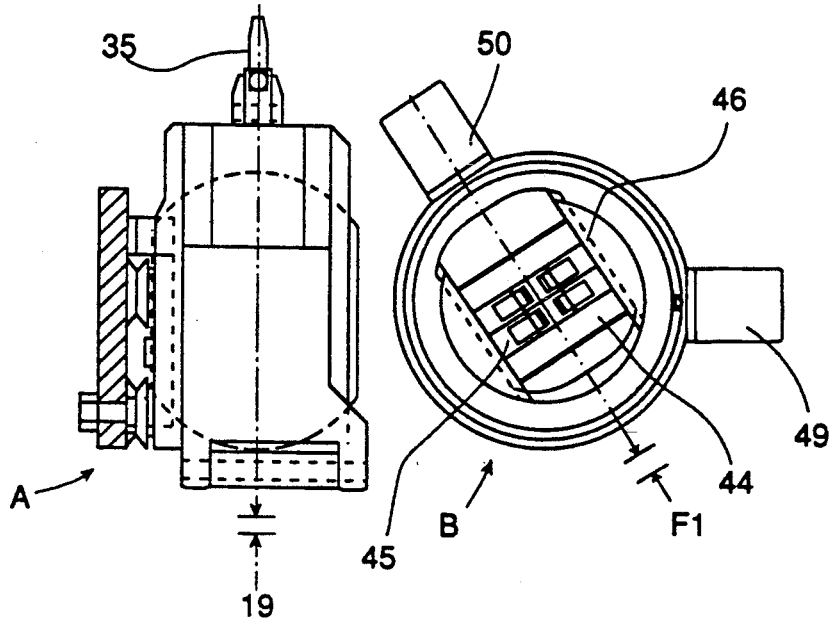
FIG. 10 is diagrammatically a plan view of the machine of FIG. 5, showing the step of seizing the first link for a "Garibaldi module", from a link forming machine.
Figure 11:
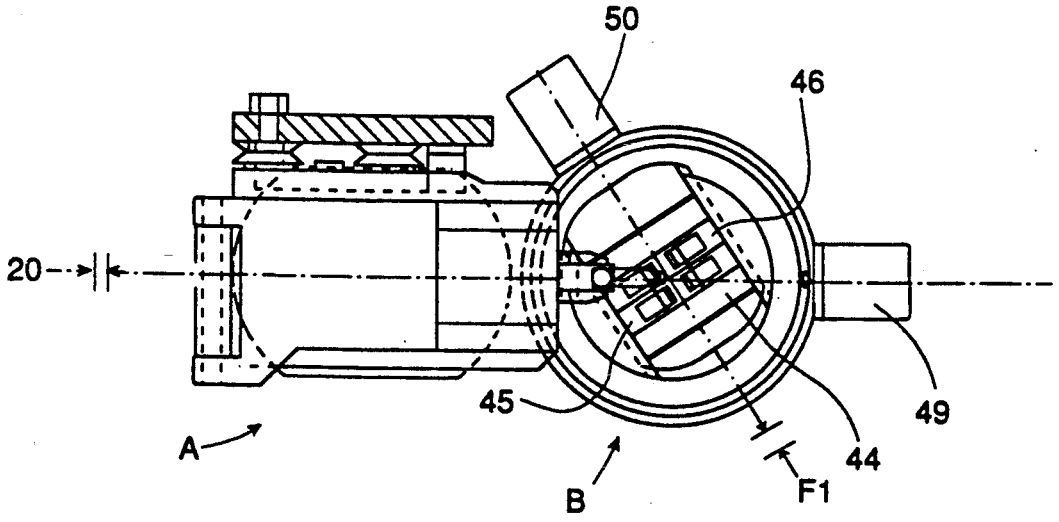
FIG. 11 is the machine of FIG. 5 in the position for forming a free and movable connection of the first link of the module with the last connected link of the chain in the process of formation.
Figure 12:
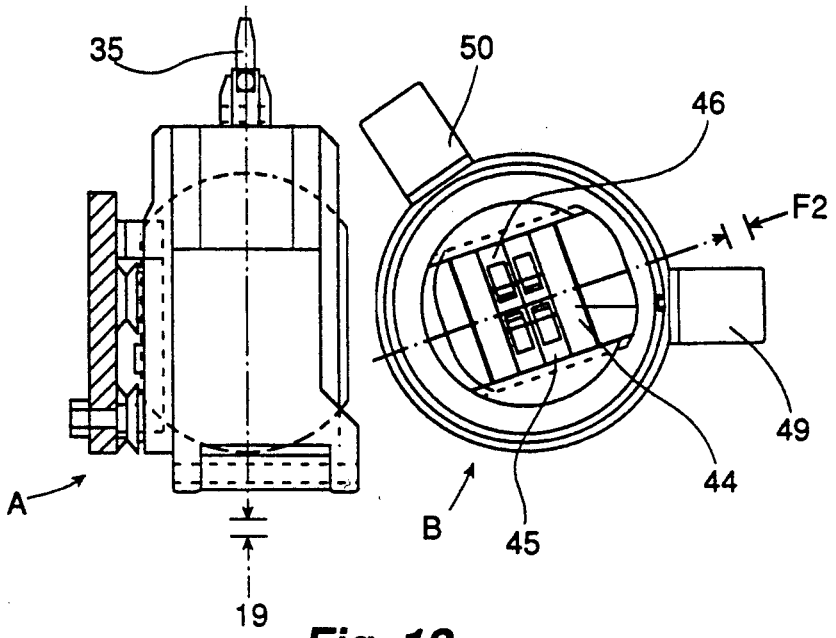
FIG. 12 is the machine of FIG. 5, upon the step of seizing a second link from the link forming machine.
Figure 13:
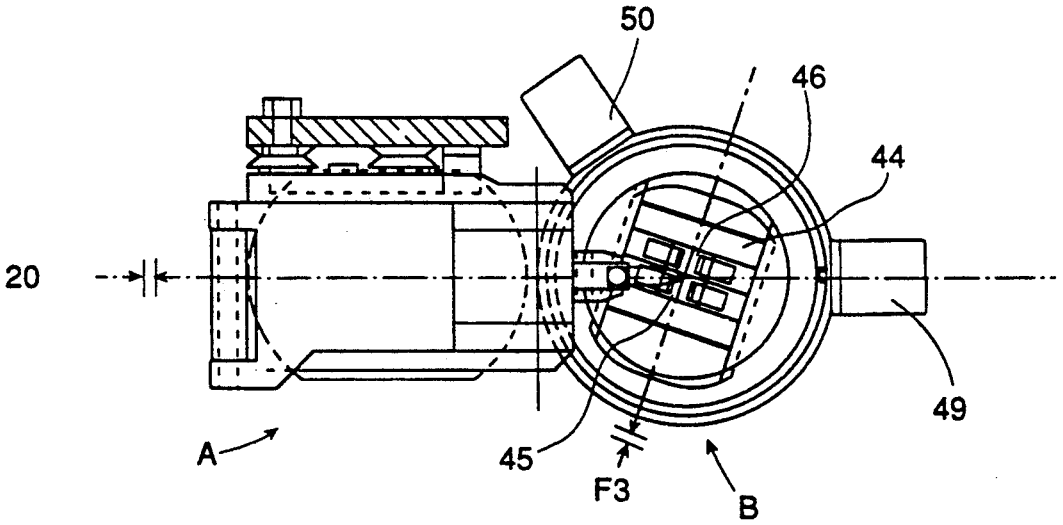
FIG. 13 is the machine of FIG. 5 in the position for the fixed and rigid connection of the second link with the first link of the "Garibaldi module".

With reference to FIGS. 5 and 9 of the attached drawings, a machine S, for the formation of helical links 1 associated with the chain forming machine according to the invention, is similar to the one for the production of spiral springs and comprises in practice a plurality of motorized rollers 54 for the horizontal advancement of the wire 55 having a predetermined diameter and fed by a reel (not shown). Two counteracting pins 56, 57, disposed in a vertical plane at an angle of 45° to the wire advancement direction above and below the wire respectively, with concave ends having a circular profile to cause bending of the wire according to the present diameter. A helix pin 58 overhanging and sideways displaced with respect to the above mentioned pins 56, 57 to produce a helix, with the wire bent into a ring, of a preset pitch but substantially equal to twice the diameter of the wire being used. A cutter 59 for cutting every helical link with an angular development slightly lower than two loops, e.g. of about 700°.

With reference to FIGS. 10 to 13 of the attached drawings, the operation of a machine for the formation of ornamental chains made up of "Garibaldi modules" according to the invention in as follows. In the starting position, shown in FIG. 10, the first collet 35 of section A for the handling of loose links is facing the link forming machine S and is in an outwardly advanced position owing to actuator 19 acting upon the support 16. The shaft 42 of section B for the blocking of connected links is in a lowered position. The axis of support 44 is oriented in the direction of arrow Fl and aligned with the axis of actuator 50. Clamp 45 is in a grip active position for the clamping of the lower link of a "Garibaldi module" which is kept vertical and whose upper link is in a condition for connecting. First collet 35 then grips onto a coil free end of wire 56 exiting machine S, and a link 1, having length slightly less than two loops, is cut by the cutter 59. Support 16 then moves back and rotates through 90° in clockwise direction while at the same time the actuator 20 moves the support 16 again into the advanced position thereby positioning the free end of the loose link 1 held by the first collet 35 in the vicinity of the next link which is in clamp 45 and in condition for connection (see FIG. 11). Then the support 22 rotates upwards on the sector 23 by tilting the collet-holder shaft 29 of about 20° with respect to a vertical plane and whose center is in correspondence of the end 1*b* of the link 1 to be connected. Thereafter, the collet-holder shaft 29 rotates about a turn and a half and moves forward by nearly a pitch and a half of the link helix, thereby obtaining a free and movable connection of the two concerned links.

In the meantime, the rod 48 lifts up and opens the clamp 45, and a second collet 51 moves forward toward the support 44 bringing clamp 46 into a grip position. The driving shaft 42 then rotates in counterclockwise direction until the axis of support 44 is in the direction of arrow F2, after which the shaft 42 and the support 44 are lifted up to bring the clamp 46 in correspondence of the overhanging link of the chain. Now first collet 35 is opened and brought into an inoperative retracted position and the shaft 12, by rotating through 90° counterclockwise, brings the open first collet 35 into cooperation with the actuator 19 into correspondence of the link-forming machine S, in order to pick up a new link to be connected (see FIG. 12). Now the support 44 is made to lower and the driving shaft 42 is rotated clockwise until the axis of support 44 is in the direction of arrow F3. The collet-holder shaft 29 rotates clockwise through 90° and the support 16 moves forward to bring an end such as 1*b* of the new link into a connection position (see FIG. 13).

Then the shaft 29 is again inclined of about 20° after which the collet-holder 29 rotates and moves forward so as to joint the free ends of the link, held by the central collet 35, between a corresponding end and the central loop of the retained link thereby determining a fixed and rigid connection. Then the clamp 46 is opened and the driving shaft 42 rotates in anti-clockwise direction for aligning the axis of support 44 with that of actuator 50 and allowing this to bring the clamp 45 back into the grip position. Then the collet-holder shaft 29 moves back to take up the horizontal position. The driving shaft 42 lifts up to allow the clamp 45 to clamp the overhanging chain link and the first collet 35 opens up releasing its link. Thereafter, it moves back into the rest position. Finally, the shaft 12 is made to rotate in an anti-clockwise direction through 90° and the actuator 19 brings back the first collet 35 into a new link holding position. Independently the driving shaft 42 goes down to allow the beginning of a new cycle for the formation of another "Garibaldi module".

It will be appreciated that this machine can be made easily suited for any type of helical link by merely replacing the clamps 45, 46 and the front cam 30 and by some adjustments on the handling means.

Practically, all the execution details may vary in any equivalent way as far as the form, dimensions, element dispositions, nature of the used materials are concerned without nevertheless departing from the scope of the adopted solution idea and therefore remaining within the limits of protection granted to the present patent for industrial invention.

I claim:

1. An apparatus for creating linked chain from helix-shaped links, the apparatus comprising:

a first section having collet means for grasping and releasing a helix-shaped link, said collet means mounted on a slide, said collet being movable on said slide, said slide being connected to a shaft and said collet means, and said slide being rotatable about said shaft, said collet means also being rotatable about a longitudinal axis of said collet means;

a second section having a clamp for clamping and releasing a last link in a created chain, said clamp having clamp position means for rotating, raising and lowering, and sliding said clamp, said second section holding and positioning said last link of the created chain for liking said last link of the created chain with said grasped link of said first section.

2. An apparatus in accordance with claim 1, further comprising:

a link-forming machine for forming the helix-shaped links and placing the helix-shaped links in a position to be grasped by said collet means.

3. An apparatus according to claim 1, further comprising:

a first thrust actuator means on said slide for positioning said collet means in an advanced position so as to grip said helix-shaped link from a link-formed machine; a second thrust actuator means on said slide for positioning said collet means in said advanced position for linking; and return means for moving said slide into a resting position.

4. Apparatus according to claim 1 wherein: said clamp has jaws with grooves capable of clamping a helical link with ends oriented away from said collet means for creating free and movable connections, and towards said collet means for creating links with fixed and rigid connections.

5. Apparatus according to claim 1 wherein:

said clamp comprises a rod having a wedge at one end vertically sliding between a low position and a high position, respectively for opening and closing said clamp.

6. Apparatus according to claim 1 further comprising:

two clamp actuators moving said clamp on a clamp slide into two corresponding directions of a feed axis of said clamp slide for an alternate positioning of said clamp into an active position for gripping of said helix-shaped link.

7. An apparatus in accordance with claim 1, further comprising:

collet shaft rotating means for rotating said collet between a receiving position for receiving the helix-shaped links, and a connection position for connecting the helix-shaped links; and collet actuating means for rotating and feeding the helix-shaped links, along said longitudinal axis of said collet means and for linking the helix-shaped links with said last link of the created chain.

8. An apparatus in accordance with claim 1, further comprising:

a circular sector means mounted on said first section for slidably moving said collet means, along a radius having a center corresponding to an end of said grasped link;

another shaft connected to said collet means on one end, said another shaft attached through a gear train to a driving shaft, said gear train having a speed ratio of 2:1; and a front cam means mounted on an end of said driving shaft for advancing said another shaft by an amount substantially equal to a pitch of the helix-shaped links.

9. A method for creating linked chain the method comprising the steps of:

feeding a wire between two rollers;

forcing said wires into concave ends of two pins disposed at an angle of substantially 45° to a feed direction of said wire, said pins being in common plane and said wire being forced into said concave ends, bending said wire into a predetermined diameter;

forcing said wire into helix pin positioned at an angle to said common plane for producing a helix from said wire bent into said predetermined diameter;

moving a cutter for cutting said helix forming a link having substantially 700° of angular development;

grasping said formed link with collet means;

moving said collet means to a clamp;

grasping said formed link with said clamp;

releasing said formed link by said collet means;

grasping another formed link with said collet means;

moving said collet means to position an end of said another formed link into a connectable position with said formed link; and rotating and advancing said another formed link to form a connection between said formed link and said another formed link in order to form the linked chain.

10. A method in accordance with claim 9, wherein:

said connectable position of said another formed link has a longitudinal axis of said another formed link inclined toward said clamp.

11. A method according to claim 9, wherein:

said forming of said connection between said formed link and said another formed link can be one of a fixed and rigid connection, and a free and movable connection; and when said free and movable connection is formed, said clamp holds a link with a fixed and rigid connection to a last link in the linked chain.

* * * * *